US005927812A

United States Patent [19]

Vanderminden, Sr.

[11] Patent Number: 5,927,812

[45] Date of Patent: Jul. 27, 1999

[54] RECLINABLE OUTDOOR CHAIR

[75] Inventor: Robert D. Vanderminden, Sr., Granville, N.Y.

[73] Assignee: Telescope Casual Furniture Company, Granville, N.Y.

[21] Appl. No.: 09/106,785

[22] Filed: Jun. 29, 1998

[51] Int. Cl.[6] ..... B60N 2/02

[52] U.S. Cl. ..... 297/377; 297/328; 297/325; 297/327

[58] Field of Search ..... 297/377, 328, 297/327, 326, 325, 21, 423–32, 411.43, 411.42

[56] References Cited

U.S. PATENT DOCUMENTS

| | | | |
|---|---|---|---|
| 2,738,001 | 3/1956 | Drabert | 297/328 |
| 4,125,286 | 11/1978 | Redel | 297/325 |
| 4,880,273 | 11/1989 | Markus | 297/325 |

FOREIGN PATENT DOCUMENTS

| | | | |
|---|---|---|---|
| 1456435 | 10/1966 | France | 297/326 |
| 6401491 | 2/1964 | Netherlands | 297/325 |
| 283367 | 9/1952 | Switzerland | 297/327 |

*Primary Examiner*—Laurie K. Cranmer
*Attorney, Agent, or Firm*—McAulay Nissen Goldberg Kiel & Hand, LLP

[57] ABSTRACT

The chair is constructed with a seat frame which is pivotally mounted at a forward end on a support frame. The rear of the seat frame is interconnected by a linkage to the support frame. The linkage includes a transverse bar which is manually movable to rest against the support legs of the support frame with the seat frame in an upright position or a reclined position.

23 Claims, 2 Drawing Sheets

RECLINABLE OUTDOOR CHAIR

This invention relates to a reclinable outdoor chair. More particularly, this invention relates to an outdoor chair which is movable between an upright position and a reclined position.

As is known, many outdoor chairs have been made of a collapsible construction so as to be folded into a flattened condition for storage purposes when not in use. However, because of the collapsible nature, these chairs have not provided a sturdy rigid construction for seating requirements and, over time, may become lose. Other outdoor chairs which are of rigid construction have been constructed so as to be stackable one within another for storage purposes but cannot be used in any position other than an upright position.

In addition, outdoor chaise lounges have been known in which a back rest only can be pivoted into different positions relative to a support frame and held in place by a pivotally mounted bracket which engages the support frame at one or more points. Typically, the brackets used in a chaise lounge to permit a back rest portion to move into one of a number of multiple positions requires the support frame to have an extended length in order to be able to support the back rest portion.

Beach chairs have been constructed with various mechanisms to allow pivoting of a back section only relative to a seat section. Typically, these mechanisms employ articulated connections and/or hinges within the frames of the chairs and particularly involving the arms of the chairs to permit movement of a back section into various reclined positions.

Accordingly, it is an object of the invention to provide an outdoor chair of generally rigid construction with a seat frame which can be positioned in an upright position or a reclined position relative to a support frame.

It is an object of this invention to provide a relatively simple linkage for use in an outdoor chair of rigid construction to pivot a seat frame relative to a support frame.

It is another object of the invention to provide a linkage of compact construction which fits within the contours of an outdoor chair of otherwise rigid construction to pivot a seat frame relative to a support frame.

Briefly, the invention provides an outdoor chair with a support frame including a plurality of support legs for resting on a support surface, a seat frame which is pivotally connected at a forward end to the support frame for receiving an occupant and a linkage interconnecting a rear of the seat frame with the support frame for pivoting of the seat frame between an upright position and a reclined position relative to the support frame.

The linkage includes a stop for resting on the support frame in each of the positions of the seat frame on the support frame in order to establish the two positions of the seat frame and to transfer the load of the seat frame onto the support frame. In one embodiment, the stop is in the form of a bar which is disposed transversely of the seat frame for resting at each of two opposite ends on the support frame. In addition, the linkage includes a pair of parallel links pivotally connected to the seat frame and a pair of parallel links pivotally connected to the support frame. In addition, each link is mounted on the transverse bar to pivot with the bar as the bar is moved from one position to the other position.

In accordance with the invention, a pair of sleeves are mounted on the ends of the transverse bar to engage the respective legs of the support frame to avoid scratching or marring of the support legs. Each sleeve is also provided with a knob at the end to provide for manual grasping of the bar to effect pivoting of the seat frame between the upright and reclined positions.

The linkage is constructed to fit within the contour of the chair and allows the seat frame to be pivoted from a conventional upright position to a reclined position in a relatively easy and secure manner. Typically, an occupant after rising from the chair may readily actuate the linkage by manually grasping the knob at either end of the linkage and by pivoting the knob into a lower position on the support leg to effect movement of the seat frame from the upright position into the reclined position. A similar procedure would be carried out by the user while standing beside the chair in order to bring the seat frame back into the upright position.

These and other objects and advantages of the invention will become more apparent from the following detailed description taking in conjunction with the accompanying drawings wherein.

Figure 1:
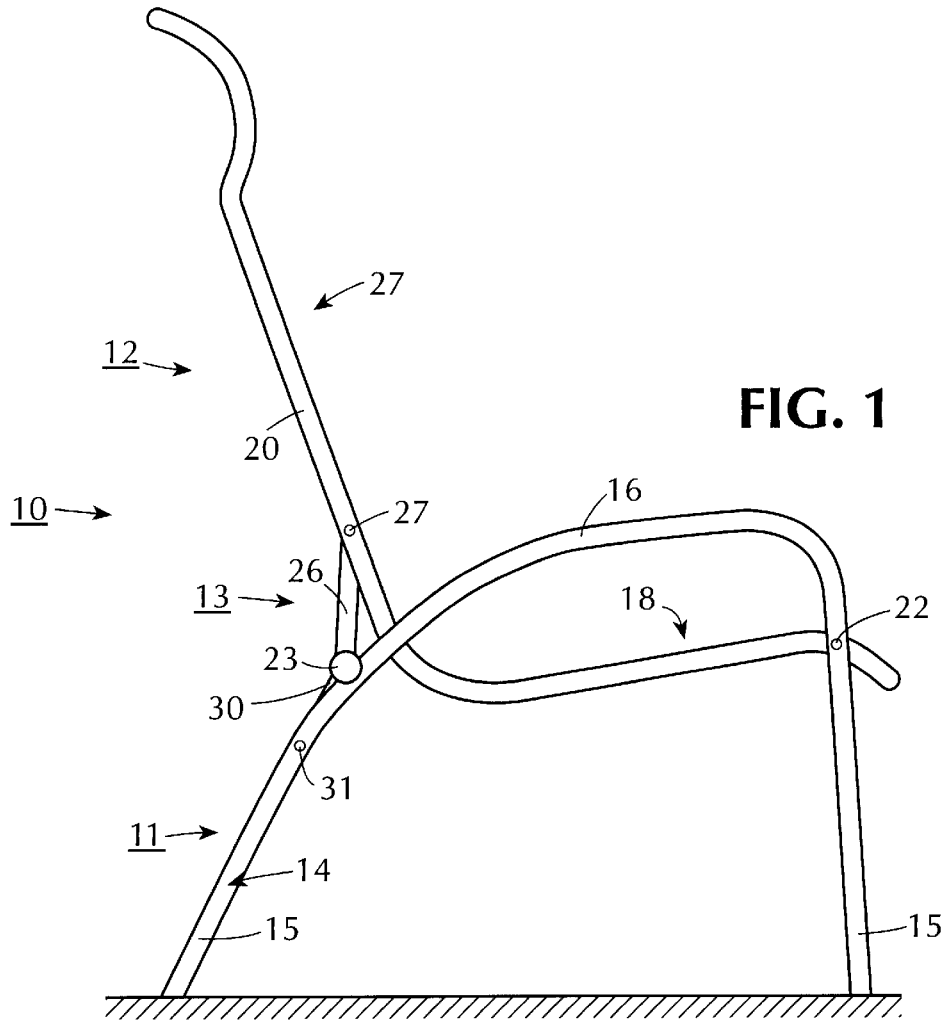
FIG. 1 illustrates a side view of an outdoor chair constructed in accordance with the invention and with the seat frame in an upright position.

Referring to FIG. 1, the outdoor chair 10 is comprised of a support frame 11, a seat frame 12 and a linkage 13 interconnecting a rear of the seat frame 12 with the support frame 11.

Figure 3:
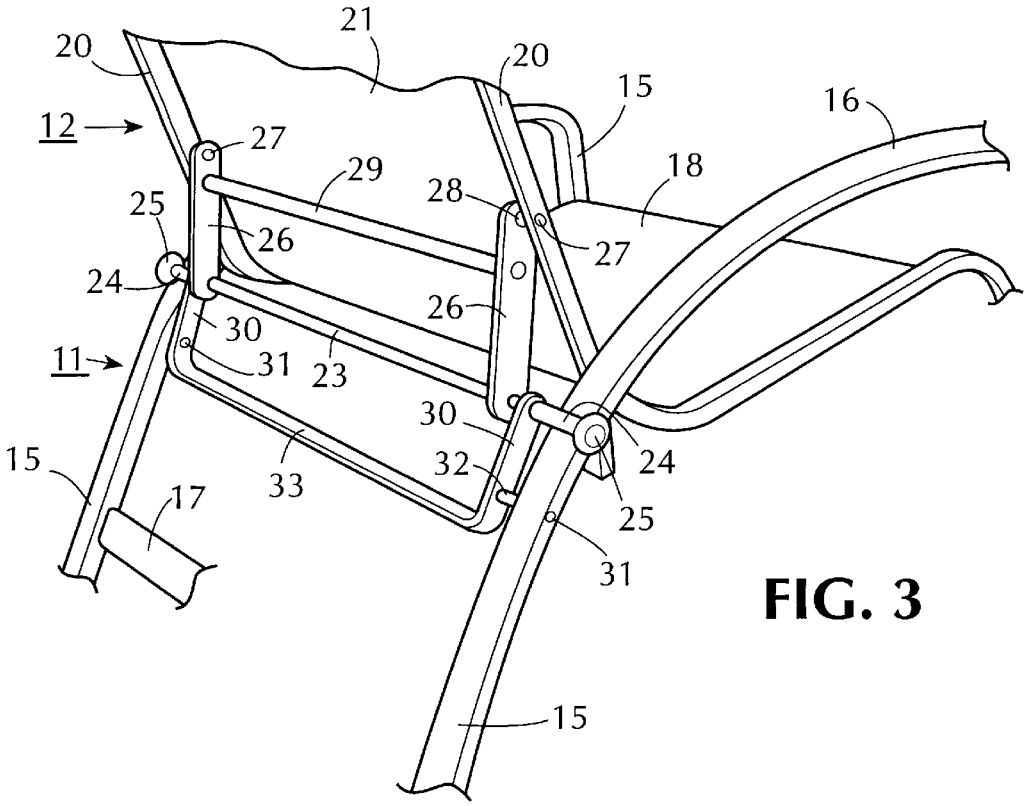
FIG. 3 illustrates a part-perspective rear view of the linkage of the chair of FIG. 1 in the upright position.

Referring to FIGS. 1 and 3, the support frame 11 is of generally conventional structure and is made for example of tubular aluminum with a powdered paint coating. The support frame 11 is rigid and includes a pair of side frames 14, each of which defines a pair of support legs 15 and an arm rest 16 between the support legs 15. As indicated, each side frame 14 is of one piece construction, the front leg 15 is straight, the rear leg 15 is curved and the arm rest 16 is flat adjacent the front leg 15 and curved adjacent the rear leg 15. In particular, the surfaces of the rear legs 15 are smooth to allow ease of production. The side frames 14 are interconnected by two spreader bars 17, one of which (not shown) is disposed near a lower end of the rear support legs 14 as illustrated in FIG. 3 and the other of which is connected under the forward end of the seat frame 12.

The seat frame 12 is of generally conventional structure and of an L-shape to define a seat portion 18 and a back portion 19. The seat frame 12 fits within the support frame 11 and includes a pair of parallel side rails 20, for example of tubular aluminum with a powdered paint coating, and a fabric 21 (see FIG. 3) secured to and between the side rails 20 in a conventional fashion to define the seat portion 18 and the back portion 19. The construction of the support frame 11 and the seat frame 12 is such as to allow the chair 10 to be stackable with other like chairs.

The seat frame 12 includes a transverse bar (not shown), for example of an inverted U-shape, at the upper end of the seat frame 12 which is secured to and between the ends of the side rails 20 to rigidify the upper end of the frame 12. This bar (not shown) may be curved away from the fabric in known fashion within an intermediate portion.

The seat frame 12 is pivotally connected to the support frame 11 on a single pivot axis which passes through a forward end of the seat frame 12 and the forward support legs 15 of the support frame 11. For example, each side rail 20 is secured as by a headed rivet or bolt 22 (FIG. 1) on the pivot axis to a front support leg 15 with a spacer, i.e. of plastic (not shown), disposed between the side rail 20 and support leg 15.

Figure 4:
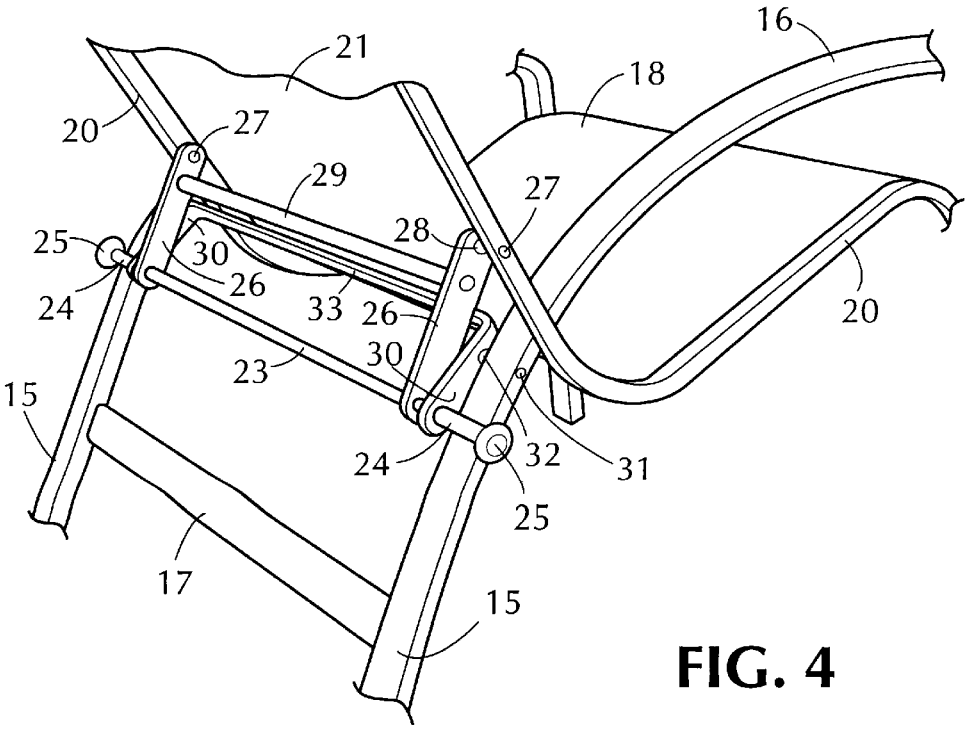
FIG. 4 illustrates a view similar to FIG. 3 with the linkage in the reclined position of the seat frame in accordance with the invention.

Referring to FIGS. 3 and 4, the linkage 13 includes a stop in the form of a elongated bar 23 which is disposed transversely of the seat frame 11 for resting at each of two opposite ends on the side frames 14 of the support frame 11 in order to support the rear of the seat frame 12 on the rear legs 15 of the support frame 11 and to transfer at least part of the load of the seat frame 12 to the support frame 11. As illustrated, the bar 23 carries a sleeve 24, for example of plastic, at each end to rest directly against the surface of a side frame 14. Each sleeve 24 also has a knob 25 which projects beyond a side frame 14 in order to provide for manual grasping of the bar 23 in order to actuate the linkage 13 to cause the seat frame 12 to pivot about the pivot bolts 22 between the upright position (FIG. 3) and the reclined position (FIG. 4) on the support frame 11.

The linkage 13 also includes a pair of parallel links 26 which are pivotally connected via pivots 27 to the side rails 20 of the seat frame 12 in a depending manner. A spacer 28 is also provided between each link 26 and the side rail 20. For example, the spacer 28 may be in the form of a pair of washers disposed on the axis of the pivot 27. A rigid bar 29 interconnects the two links 25 to impart rigidity.

The linkage 13 also has a pair of parallel links 30 pivotally connected on a common pivot axis to the legs 14 of the support frame 11 by pivots pins 31 in an upstanding manner. In addition, a spacer 32 in the form of a plastic sleeve is disposed on each pivot pin 31 between each link 30 and the support leg 15. The links 30 are interconnected by a bar 33 for rigidity purposes. As illustrated in FIG. 3, the links 30 and bar 33 may be formed in one piece as a U-shaped bar.

The links 26 depending from the rear of the seat frame 12 are secured to the transverse bar 23 in a fixed manner whereas the upstanding links 30 on the support frame 11 are disposed to pivot on the transverse bar 23.

Figure 2:
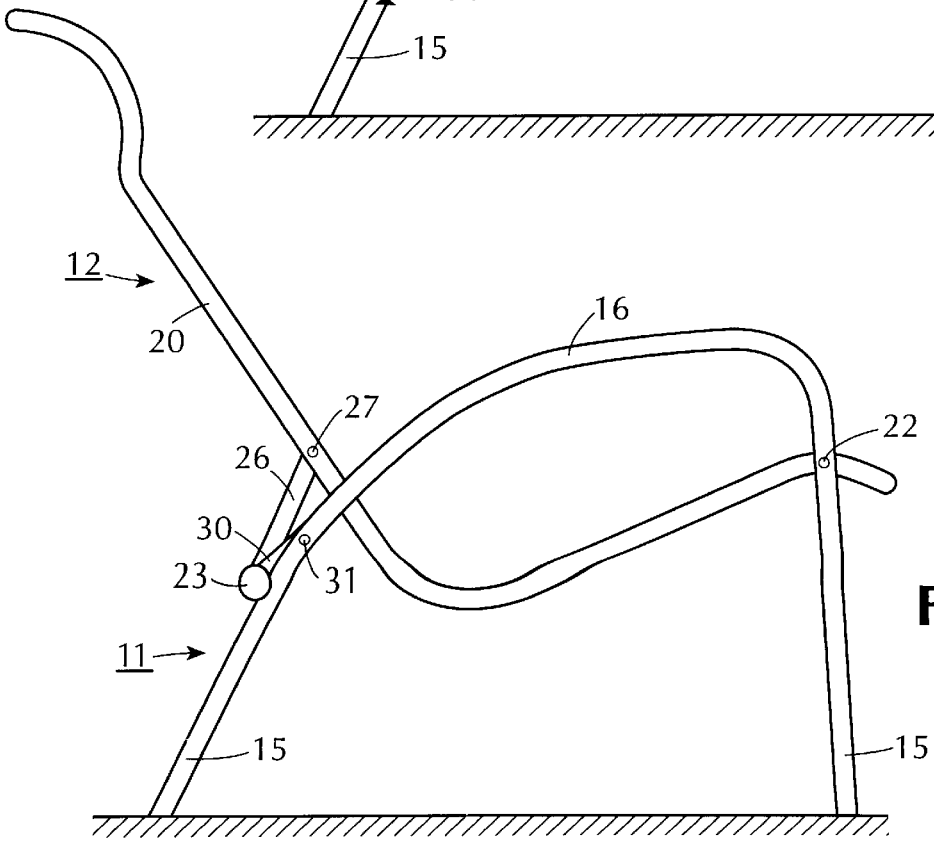
FIG. 2 illustrates a side view of the chair of FIG. 1 with the seat frame in a reclined position in accordance with the invention.

In order to move the seat frame 12 from the upright position of FIGS. 1 and 3, one or the other of the knobs 25 on the transverse bar 23 is grasped and pivoted about the pivot axis of the pivots pins 31 into the lowermost position as shown in FIGS. 2 and 4 with the bar 23 below the common axis of the pivot pins 31. At this time, the sleeves 24 on the bar 23 abut against the rear support legs 15 and the seat frame 12 is brought into the reclined position. A reverse operation will bring the seat frame 11 into the upright position shown in FIGS. 1 and 3 with the bar 23 above the common axis of the pivot pins 31 and resting on the rear support legs 15.

Pivoting of the linkage 13 is performed manually and in a simple and easy manner while the user stands to one side or the other of the chair 10. While an occupant may be seated during pivoting of the seat frame 11 between the two positions illustrated, such is not recommended in order to avoid the risk of pinching of the occupant's fingers between the transverse bar 23 and the support legs 15.

As illustrated in FIGS. 1 and 2, the linkage 13 is incorporated into the chair 10 well within the contours of the support frame 11 and seat frame 12. Further, the excursion of the transverse bar 23 along the length of the support legs 15 is such as to provide for significant pivoting of the seat frame 12 from the upright position (FIG. 1) into a reclined position (FIG. 2). For example, with the axis of the bar 23 spaced from the pivot axis of the pivot pins 31 a distance of two 2½ inches, the bar 23 may be moved approximately 5 inches along the length of the support legs 15.

Referring to FIG. 3, when the linkage 13 is in the position corresponding to the upright position of the seat frame 11, the respective pair of links 26, 30 are beyond a top dead-center position of the links 26, 30 to ensure against inadvertent pivoting of the seat frame 12 into the reclined position. That is to say, when the links 26, 30 move from the positions shown in FIG. 4, the links 26, 30 pass through a top dead-center position in which the links 26, 30 are co-linear before moving into the positions illustrated in FIG. 3. Thus, when the linkage 13 is in the position shown in FIG. 3, the weight of the seat frame 12 and the occupant is transferred through the depending links 26 and the bar 23 directly onto the rear support legs 15 at points spaced inwardly (as viewed) of the pivot pins 31 relative to the seat frame 12 while the links 30 restrain the bar 23 in compression. When the linkage 13 is in the position shown in FIG. 4, the weight of the seat frame 12 and the occupant is transferred through the depending links 26 and the bar 23 directly onto the rear support legs 15 at the points spaced outwardly (as viewed) of the pivot pins 31 while the links 30 restrain the bar 23 in tension. In either position, the rear support leg 15 may be smooth-surface without need for indentations or the like to receive the bar 23. Thus, the side frames 14 of the support frame 11 can be easily made and shaped.

Alternatively, the seat frame 12 may be moved from the reclined position by pushing forward on an upper part of the seat frame 12 thereby pivoting the seat frame 12 from the position shown in FIG. 4 towards the upright position illustrated in FIG. 3. Once the links 26, 30 of the linkage 13 move into a top dead-center position, the bar 23 may be manually grasped and pushed inwardly toward the seat frame 12. At this time, the bar simultaneous pivots the links 26 toward the seat frame 16 so as to effect locking of the seat frame 12 in the upright position.

The invention thus provides an outdoor chair with a seat frame which can be readily moved between an upright position and a reclined position relative to a support frame while otherwise being of rigid construction.

The invention further provides a chair with a seat frame which can be moved between an upright position and a reclined position using a linkage which not only transfers the load of the seat frame directly to the support frame but one which is of compact construction which fits within the contour of the chair.

The invention further provides an outdoor chair which can be used for dining when the seat frame is in an upright position and for relaxing when the seat frame is in a reclined position.

The invention also provides a linkage which can be readily retrofitted into existing outdoor chairs having a seat frame rigidly secured to a support frame provided a pivot is used to secure the front of the seat frame to the support frame.

What is claimed is:

1. An outdoor chair comprising a rigid support frame including a plurality of support legs for resting on a support surface;

a seat frame for receiving an occupant, said seat frame being pivotally connected at a forward end to said support frame; and a linkage interconnecting a rear of said seat frame with said support frame for pivoting of said seat frame between an upright position and a reclined position relative to said support frame.

2. An outdoor chair as set forth in claim 1 wherein said support frame includes a pair of parallel side frames, each said side frame defining a pair of said support legs and an arm rest between said pair of support legs.

3. An outdoor chair as set forth in claim 2 wherein said linkage includes a bar disposed transversely of said seat frame for resting at each of two opposite ends on a respective one of side frames in each of said positions of said seat frame on said support frame.

4. An outdoor chair as set forth in claim 3 wherein said linkage includes a pair of parallel links pivotally connected to said seat frame and a pair of parallel links pivotally connected to said support frame; each said respective link being mounted on said bar.

5. An outdoor chair as set forth in claim 3 which further comprises a pair of sleeves, each sleeve being mounted on said bar to engage a respective leg of said support frame and having a knob at one end to provide for manual grasping of said bar to pivot said seat frame between said positions thereof.

6. An outdoor chair as set forth in claim 1 wherein said seat frame includes a pair of parallel side rails of generally L-shape and a fabric secured to and between said side rails to define a seat portion and an upraised back portion.

7. An outdoor chair comprising a support frame including a pair of parallel side frames, each said side frame defining a pair of support legs and an arm rest between said support legs;

a generally L-shaped seat frame defining a seat portion and a back portion, said seat frame being pivotally mounted at a forward end to said side frames of said support frame; and a linkage interconnecting said back portion of said seat frame to said side frames of said support frame for pivoting of said seat frame between an upright position and a reclined position relative to said support frame.

8. An outdoor chair as set forth in claim 7 wherein said linkage includes a stop for resting on said support frame in each of said positions of said seat frame on said support frame.

9. An outdoor chair as set forth in claim 8 wherein said stop is a bar disposed transversely of said seat frame for resting at each of two opposite ends on said support frame.

10. An outdoor chair as set forth in claim 9 wherein said linkage includes a pair of parallel links pivotally connected to said seat frame and a pair of parallel links pivotally connected to said support frame on a common pivot axis; each said respective link being mounted on said bar.

11. An outdoor chair as set forth in claim 10 wherein said bar is disposed inwardly of said common pivot axis relative to said seat frame with said seat frame in said upright position.

12. An outdoor chair as set forth in claim 7 which further comprises a pair of sleeves, each sleeve being mounted on said bar to engage a respective leg of said support frame and having a knob at one end to provide for manual grasping of said bar to pivot said seat frame between said positions thereof.

13. An outdoor chair as set forth in claim 7 wherein said linkage includes a first pair of parallel links pivotally connected to said seat frame and a second pair of parallel links pivotally connected to said support frame and to said first pair of links.

14. An outdoor chair as set forth in claim 13 wherein said linkage includes a bar extending between and connected to said second pair of links for simultaneously pivoting said second pair of links on said seat frame.

15. An outdoor chair as set forth in claim 14 wherein said first pair of links is disposed on a common pivot axis passing through said support frame and said bar is disposed outwardly of said common pivot axis in said reclined position of said seat frame and inwardly of said common pivot axis in said upright position of said seat frame.

16. An outdoor chair comprising a support frame including a plurality of support legs for resting on a support surface;

a seat frame for receiving an occupant, said seat frame being pivotally connected at a forward end to said support frame; and a linkage interconnecting a rear of said seat frame with said support frame for pivoting of said seat frame between an upright position and a reclined position relative to said support frame, said linkage including a stop for resting on said support frame in each of said positions of said seat frame on said support frame.

17. An outdoor chair as set forth in claim 16 wherein said stop is a bar disposed transversely of said seat frame for resting at each of two opposite ends on said support frame.

18. An outdoor chair as set forth in claim 17 wherein said linkage includes a pair of parallel links pivotally connected to said seat frame and a pair of parallel links pivotally connected to said support frame on a common pivot axis, each said respective link being mounted on said bar.

19. An outdoor chair as set forth in claim 18 wherein said bar is disposed inwardly of said common pivot axis relative to said seat frame with said seat frame in said upright position.

20. An outdoor chair as set forth in claim 17 which further comprises a pair of sleeves, each sleeve being mounted on said bar to engage a respective leg of said support frame and having a knob at one end to provide for manual grasping of said bar to pivot said seat frame between said positions thereof.

21. An outdoor chair comprising a support frame including a plurality of support legs for resting on a support surface;

a seat frame for receiving an occupant, said seat frame being pivotally connected at a forward end to said support frame; and a linkage interconnecting a rear of said seat frame with said support frame for pivoting of said seat frame between an upright position and a reclined position relative to said support frame, said linkage including a first pair of parallel links pivotally connected to said seat frame and a second pair of parallel links pivotally connected to said support frame and to said first pair of links.

22. An outdoor chair as set forth in claim 21 wherein said linkage includes a bar extending between and connected to said second pair of links for simultaneously pivoting said second pair of links on said seat frame.

23. An outdoor chair as set forth in claim 22 wherein said first pair of links is disposed on a common pivot axis passing through said support frame and said bar is disposed outwardly of said common pivot axis in said reclined position of said seat frame and inwardly of said common pivot axis in said upright position of said seat frame.

* * * * *